US006885300B1

(12) United States Patent
Johnston et al.

(10) Patent No.: US 6,885,300 B1
(45) Date of Patent: Apr. 26, 2005

(54) BROAD FIELD MOTION DETECTOR

(75) Inventors: Kendall Ryan Johnston, Santa Clara, CA (US); Roar Viala, Palo Alto, CA (US)

(73) Assignee: The Watt Stopper, Inc., Santa Clara, CA (US)

( * ) Notice: Subject to any disclaimer, the term of this patent is extended or adjusted under 35 U.S.C. 154(b) by 46 days.

(21) Appl. No.: 10/163,409

(22) Filed: Jun. 5, 2002

(51) Int. Cl.[7] ..... G08B 13/00
(52) U.S. Cl. ..... 340/541; 340/553; 73/652
(58) Field of Search ..... 340/541, 551, 340/552, 553, 554, 561, 565, 567

(56) References Cited

U.S. PATENT DOCUMENTS

| | | | |
|---|---|---|---|
| 3,912,866 A | 10/1975 | Fox | 179/1 E |
| 3,993,569 A | 11/1976 | Zinsmeyer et al. | 250/209 |
| 4,021,679 A | 5/1977 | Bolle et al. | 307/117 |

(Continued)

OTHER PUBLICATIONS

Vishay, Vishay Telefunken, "Physics of Optoelectronic Devices Light–Emitting Diodes,"Dec. 1999, pp. 1–7.
Vishay, Vishay Telefunken, "Measuring Techniques General," Dec. 1999, pp. 1–9.
Asian Technology Information Program (ATIP), "Blue LED's: Breakthroughs and Implications," ATIP Report ATIP95.59, Aug. 27, 1995, See www.cs.arizona.edu/japan/atip/public/atip.reports.95/atip95.59r.html.
Energy User News, "The Coming Revolution in Lighting Practice," by Sam Berman, Oct. 2000, pp. 24–26.
IESNA Paper #59, "Characterizing Daylight Photosensor System Performance to Help Overcome Market Barriers," by Andrew Bierman et al.
Journal of the Illuminating Engineering Society, "Improving the Performance of Photo–Electrically Controlled Lighting Systems," by Francis Rubinstein et al., Winter 1989, pp. 70–94.
Specifier Reports, "Photosensors– Lightsensing devices that control output form electric lighting systems", National Light Product Information Program, vol. 6, No. 1, Mar. 1998, p. 1 of 20.
"Si Photodiode—S7686", Hamamatsu, pp. 1.
"Si Photodiodes—S6626, S6838", Hamamatsu, pp. 1–2.
"Si Photodiodes—S7160, S7160–01", Hamamatsu, pp. 1–2.

*Primary Examiner*—Benjamin C. Lee
*Assistant Examiner*—Son Tang
(74) *Attorney, Agent, or Firm*—Haverstock & Owens LLP

(57) ABSTRACT

A motion sensing system device and method which utilize dispersed ultrasonic radiation is disclosed. The system preferably comprises a low profile sensor unit configured to couple to a ceiling position. The sensor unit comprises an ultrasonic transmitter and an ultrasonic receiver and a pair of acoustic reflectors positioned in a transmitting path of the ultrasonic transmitter and a receiving path of the ultrasonic receiver for generating and detecting the ultrasonic radiation in a broadcast field. The acoustic reflectors preferably comprise cones, conical cross-sections and/or combinations thereof which are integral with the ultrasonic transmitter and the ultrasonic receiver and/or are coupled to a housing structure for positioning the acoustic reflectors in the transmitting and/or receiving paths. The sensor unit also preferably comprises a circuit for driving the transmitter and for detecting motion by detecting changes in the receiver signal. In further embodiments, the system also includes an infrared sensor and is configured to generate a response based on the combination of changes in the receiver signal and a signal form the infrared sensor.

25 Claims, 10 Drawing Sheets

U.S. PATENT DOCUMENTS

| | | | | | |
|---|---|---|---|---|---|
| 4,093,943 | A | | 6/1978 | Knight | 340/220 |
| 4,107,659 | A | * | 8/1978 | Massa | 340/552 |
| 4,184,562 | A | * | 1/1980 | Bakamjian | 181/107 |
| 4,233,545 | A | | 11/1980 | Webster et al. | 250/214 AL |
| 4,330,706 | A | | 5/1982 | Lawenhaupt | 250/214 AL |
| 4,458,170 | A | * | 7/1984 | Takayama et al. | 310/322 |
| 4,607,186 | A | * | 8/1986 | Takayama et al. | 310/324 |
| 4,628,496 | A | | 12/1986 | Lee | 367/93 |
| 4,695,769 | A | | 9/1987 | Schweickardt | 315/158 |
| 4,751,623 | A | | 6/1988 | Gaines et al. | 362/276 |
| 4,757,430 | A | | 7/1988 | Dubak et al. | 362/100 |
| 4,815,046 | A | * | 3/1989 | Dorr | 367/95 |
| 4,820,938 | A | | 4/1989 | Mix et al. | 307/117 |
| 4,914,859 | A | * | 4/1990 | Gionet et al. | 49/25 |
| 5,015,994 | A | | 5/1991 | Hoberman et al. | 340/567 |
| 5,185,728 | A | * | 2/1993 | Gilchrist | 367/163 |
| 5,189,393 | A | * | 2/1993 | Hu | 340/522 |
| 5,251,188 | A | * | 10/1993 | Parsons et al. | 367/140 |
| 5,307,051 | A | | 4/1994 | Sedlmayr | 340/573 |
| 5,386,210 | A | | 1/1995 | Lee | 340/567 |
| 5,424,745 | A | * | 6/1995 | Fonsny | 342/28 |
| 5,442,177 | A | | 8/1995 | Boulos et al. | 250/342 |
| 5,489,827 | A | | 2/1996 | Xia | 315/294 |
| 5,495,402 | A | | 2/1996 | Houssian | 362/226 |
| 5,495,766 | A | * | 3/1996 | Kota et al. | 73/652 |
| 5,638,824 | A | * | 6/1997 | Summers | 600/437 |
| 5,640,143 | A | | 6/1997 | Myron et al. | 340/541 |
| 5,652,567 | A | * | 7/1997 | Traxler | 340/552 |
| 5,699,243 | A | | 12/1997 | Eckel et al. | 364/140 |
| 5,701,058 | A | | 12/1997 | Roth | 315/158 |
| 5,713,655 | A | | 2/1998 | Blackman | 362/95 |
| D393,912 | S | | 4/1998 | Yuen | D26/26 |
| 5,763,872 | A | | 6/1998 | Ness | 250/214 AL |
| 5,867,099 | A | | 2/1999 | Keeter | 340/567 |
| D409,317 | S | | 5/1999 | Yuen | D26/26 |
| 5,932,861 | A | | 8/1999 | Iwaguchi et al. | 235/455 |
| 5,946,209 | A | | 8/1999 | Eckel et al. | 364/143 |
| 6,051,787 | A | | 4/2000 | Rintz | 174/66 |
| D425,222 | S | | 5/2000 | Yuen | D26/26 |
| D425,638 | S | | 5/2000 | Yuen | D26/26 |
| 6,084,231 | A | | 7/2000 | Popat | 250/214 AL |
| 6,087,588 | A | | 7/2000 | Soules | 174/66 |
| 6,087,760 | A | * | 7/2000 | Yamaguchi et al. | 310/334 |
| 6,114,956 | A | * | 9/2000 | Van Genechten | 340/552 |
| D431,660 | S | | 10/2000 | Yuen | D26/26 |
| 6,132,057 | A | | 10/2000 | Williams | 362/100 |
| 6,151,529 | A | | 11/2000 | Batko | 700/28 |
| 6,172,301 | B1 | | 1/2001 | Goodsell | 174/66 |
| RE37,135 | E | | 4/2001 | Elwell | 315/154 |
| 6,337,541 | B1 | | 1/2002 | Dickie et al. | 315/169.3 |
| 6,343,134 | B1 | | 1/2002 | Czerwinski | 381/342 |
| 6,390,647 | B1 | | 5/2002 | Shaefer | 362/276 |
| 6,566,882 | B2 | | 5/2003 | Baldwin et al. | 324/418 |

* cited by examiner

BROAD FIELD MOTION DETECTOR

FIELD OF THE INVENTION

The invention relates to motion detectors. More particularly, the present invention relates to motion detectors which utilize ultrasonic radiation.

BACKGROUND OF THE INVENTION

A number of different motion detector systems are known. One type of motion detector utilizes ultrasonic radiation, such as described in U.S. Pat. No. 4,820,938 issued to Mix et al., the content of which is hereby incorporated by reference. In an ultrasonic motion detector, a detection field of ultrasonic radiation is generated and is monitored for Doppler shifts, which are indicative of motion. Such motion sensors are integrated with a light management system, wherein lights are turned off, turned on and/or are dimmed according to the detection of motion or a lack of detected motion.

One of the shortcomings of current motion detector systems and devices is that they typically are only effective for detecting motion in a small area and are ineffective at monitoring motion at or near walls. Accordingly, these motion detector systems and devices typically require that detector units are strategically positioned in corners of a room or in a narrow corridor, such that the detector units broadcast through the room or corridor into an area where motion is most likely to occur. Despite the strategic positioning of the detector units, such devices and systems are ineffective at monitoring motion at or near walls or through an entire room. Such systems or devices can be protrusive and unattractive.

Further, it is generally preferably to have a ultrasound motion detectors that operate at a sufficiently high frequency (about 40 KHz) such that interference with hearing aides, and the like, are minimized. Unfortunately, the energy of ultrasound waves at these higher frequencies are attenuated by air to a greater degree than lower frequencies. Accordingly, motion defectors which operate at these high frequencies can require several transducers to effectively detect motion in a room.

In view of the aforementioned shortcomings, what is need is a motion detector system and device which more effectively monitors and detects motion in a large area and which preferably is easily integrated with the architecture of a room. Further, what is needed is a motion detector system and device which is capable of effectively detecting motion in a room using high frequency ultrasound waves.

SUMMARY OF THE INVENTION

The current invention is directed to a system and a device for and a method of sensing motion. A system, in accordance with the instant invention, comprises one or more motion detector units for sensing the motion. Each motion detector unit comprises one or more transducers comprising at least one transmitter for emitting the ultrasonic radiation and at least one receiver for receiving the ultrasonic radiation. Preferably, however, each motion detector unit comprises a single transmitter and receiver pair. The motion detector unit is preferably configured to broadcast the ultrasonic radiation in a detection area with a dispersion angle of 45 degrees or greater.

The transmitter and receiver pair preferably transmit and receive ultrasound radiation at a frequencies above 20 KHz and more preferably at or near 40 KHz to minimize interference with hearing aides, and in order to minimize potentially adverse physiological effects. The preferred embodiments of the invention serve to disperse the transmitted waves and focus the received waves to efficiently utilize the ultrasonic energy that is returned at the sensor, such that the sensor's coverage area is optimized for given output energy and frequency.

In accordance with the preferred embodiments of the invention, the transducer is coupled, with an acoustic propagation modifier, which disperses the ultrasonic radiation. The acoustic propagation modifier preferably comprises a pair of acoustic reflectors, wherein a first acoustic reflector is positioned in a transmitting path of the ultrasonic transmitter and a matched acoustic reflector is positioned in a receiving path of the ultrasonic receiver.

The acoustic reflectors have one of any number of shapes and sizes and are formed from one of any number of different materials suitable to disperse the ultrasonic radiation. The acoustic reflectors comprise one or more angled surfaces to disperse the ultrasonic radiation and preferably, the acoustic reflectors comprise a cone section and one or more conical cross-sections which collectively disperse the ultrasonic radiation. More preferably, the cone section is centrally positioned within two or more concentrically positioned conical cross-sections. The acoustic reflectors are integral with the transmitter and/or receiver or alternatively are separate therefrom. For example, the acoustic reflectors are coupled to transmitter and/or receiver casings or are coupled to a housing or cover configured for positioning the acoustic reflectors in the transmitting path of the transmitter and the receiving path of the receiver.

A sensor unit, in accordance with the instant invention also preferably comprises a circuit coupled to the transducer. The circuit is configured to drive the transmitter at a selected frequency and is configured for generating receiver signals for Doppler shifts or disturbances detected by the receiver in a broadcast region. In the event that a disturbance of sufficient magnitude is detected, the circuit is configured to generate a suitable response. Alternatively, in the event that no disturbance is detected, the circuit is configured to generate a suitable response. A suitable response includes, but is not limited to, operating lights, sounding alarms and initiating telephone calls. In further embodiments, the sensor unit includes an infrared sensor for sensing heat, whereby a suitable response is determined based on the combined signals generated by the motion sensor unit and the infrared sensor.

The system of the current invention is networked with any other number of building monitoring systems and includes any number of sensor units, such as described above, which operate independently or collectively. In accordance with a preferred embodiment of the invention, a sensor unit is housed in a low-profile housing structure, that is configured to couple to a ceiling position within a room and monitor motion in the room therefrom.

DETAILED DESCRIPTION OF THE INVENTION

Figure 1:
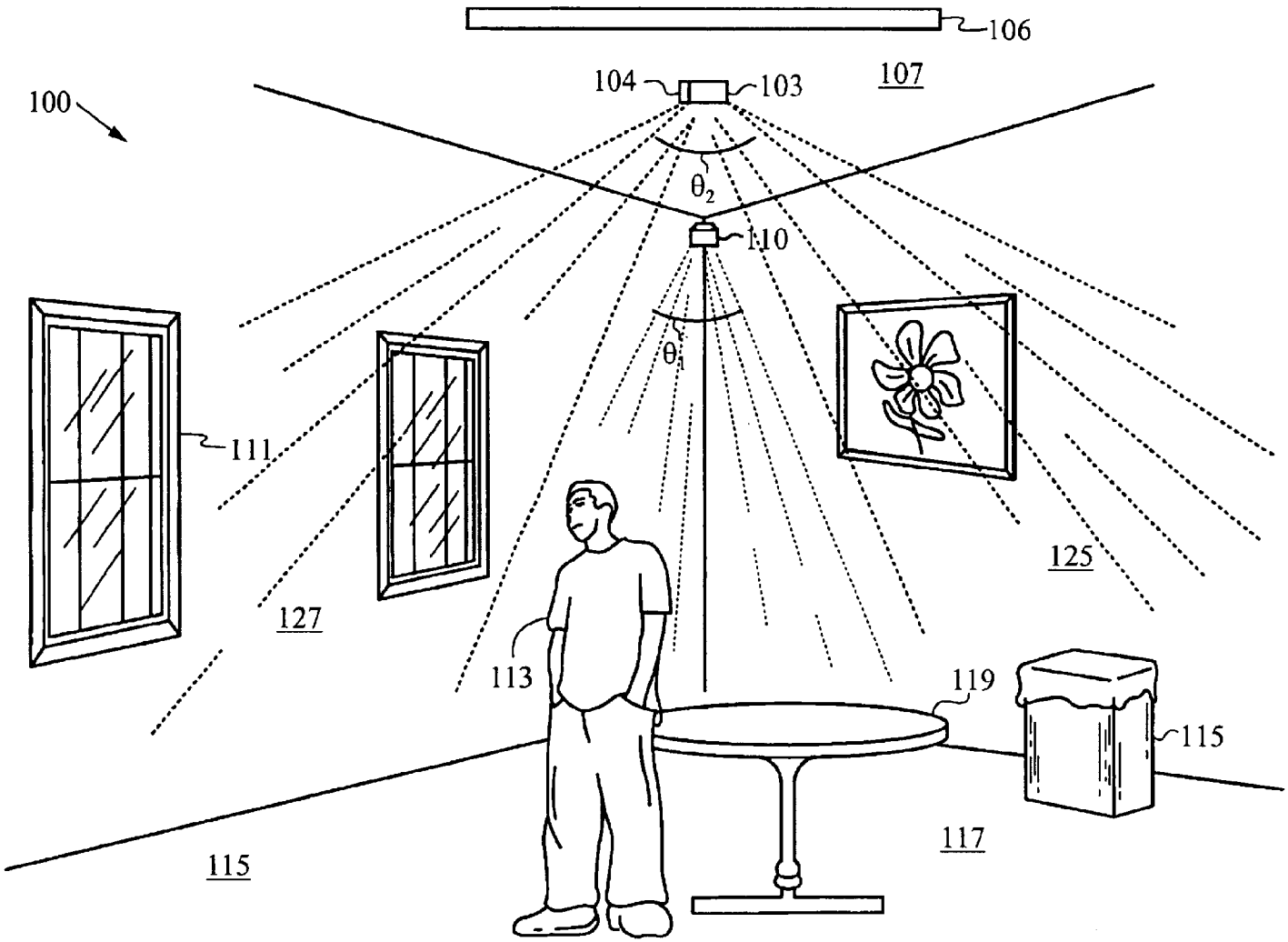
FIG. 1 shows a schematic perspective view of a preferred location for positioning a motion detector, in accordance with the instant invention.

FIG. 1 shows a perspective view of a room 100 with a prior art ultrasonic motion detector 110 for broadcasting ultrasonic radiation in a first detection field. The first detection field generated by the prior art ultrasonic motion detector 110 typically has a small dispersion angel $\theta_1$, on the order of 30 degrees or less. Accordingly, to maximize the effectiveness of the motion detector 110, the detector 110 needs to be positioned in a corner and broadcast ultrasonic radiation out across the room to detect motion of objects, such as a table 119 or a person 113, in the center of the room. Regardless, of the strategic positioning of the prior art sensor 110, such prior art sensors are generally ineffective at detecting motion of objects in regions near the walls 125 and 127 or under the motion detection 110. For example, the detector 110, generally can not detect motion of the window 111 on the wall 127 or the garbage can 115 near the wall 125.

Still referring to FIG. 1, the current invention is directed to a motion detector 103, that is preferably configured to couple to a position on a ceiling 107 of the room 100. The motion sensor 103 is preferably configured to broadcast ultrasonic radiation in a detection field with a large dispersion angel $\theta_2$ for detecting object motion in the room 100. More preferably, the motion sensor 103 is configured to couple to an electrical junction box (not shown) and is capable of being recessed into the ceiling 107 such that the motion detector 103 appears integral with the ceiling 107 of the room 100.

The motion sensor 103, in accordance with the instant invention is configured to turn on the light 106, when motion is detected in the room 100, and/or to turn off the light 106 in the event that no motion is detected. The sensor unit 103 also has an infrared sensor 104 for discerning between disturbances generated by a person 113 or an inanimate object 111, 115 and 119 and/or to help reduce the number of false alarms. Ultrasonic motion detectors which include an infrared sensor are described in the U.S. Pat. No. 5,189,393, issued to Hu, the content of which is hereby incorporated by reference.

Figure 2A:
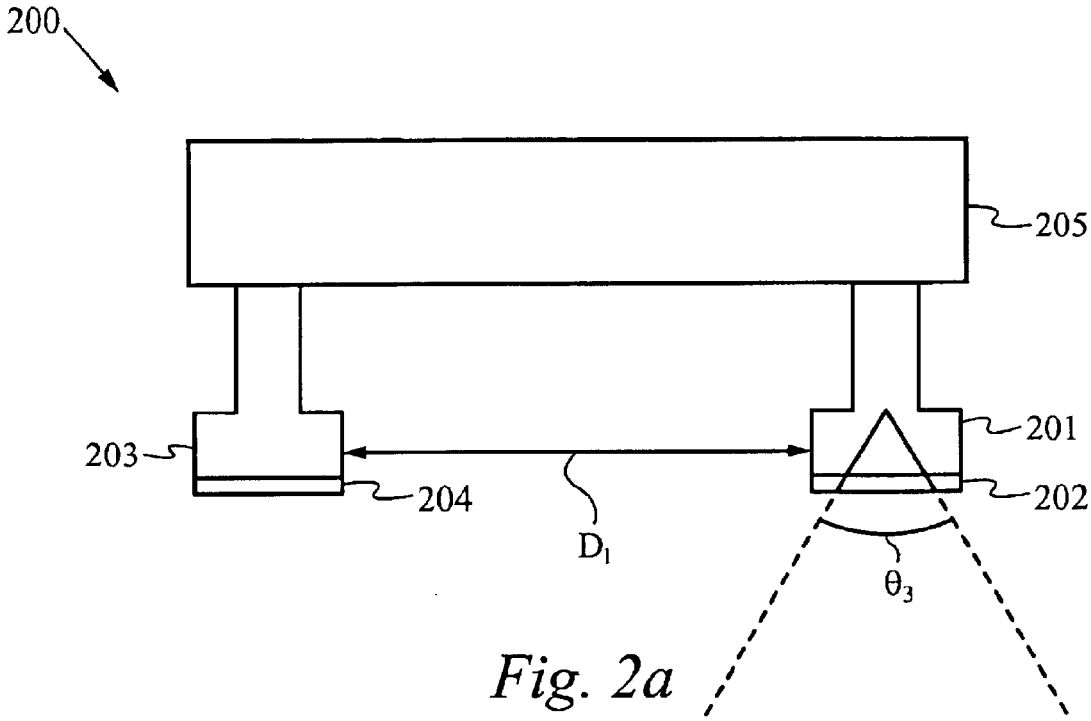
FIGS. 2*a–b* are cross-sectional representations of sensor units without and with acoustic modifiers, respectively.

Now referring to FIG. 2*a*, a sensor unit 200 in accordance with the instant invention comprises a transducer comprising at least one ultrasonic transmitter 201 and at least one ultrasonic receiver 203. The transmitter 201 is coupled to a circuit 205 that is configured to drive the transmitter membrane 202 at one or more frequencies of 20 KHz or higher. Preferably, the circuit unit 205 is configured to vibrate the transmitter membrane 202 at a frequency of approximately 40 KHz. The transmitter 201 and the receiver 203 can be positioned at any suitable distance $D_1$ relative to each other, but are preferably in close proximity and are contained in the same sensor unit 200. The ultrasonic receiver 203 has a receiver membrane 204 configured to sense the ultrasonic radiation generated by the transmitter 201 and to generate a receiver signal therefrom. The circuit unit 205 is configured to monitor changes in the receiver signal and/or differences between the transmitter signal and the receiver signal and to initiate a response based on the changes in the receiver signal and/or differences between the transmitter signal and the receiver signal.

Figure 2B:
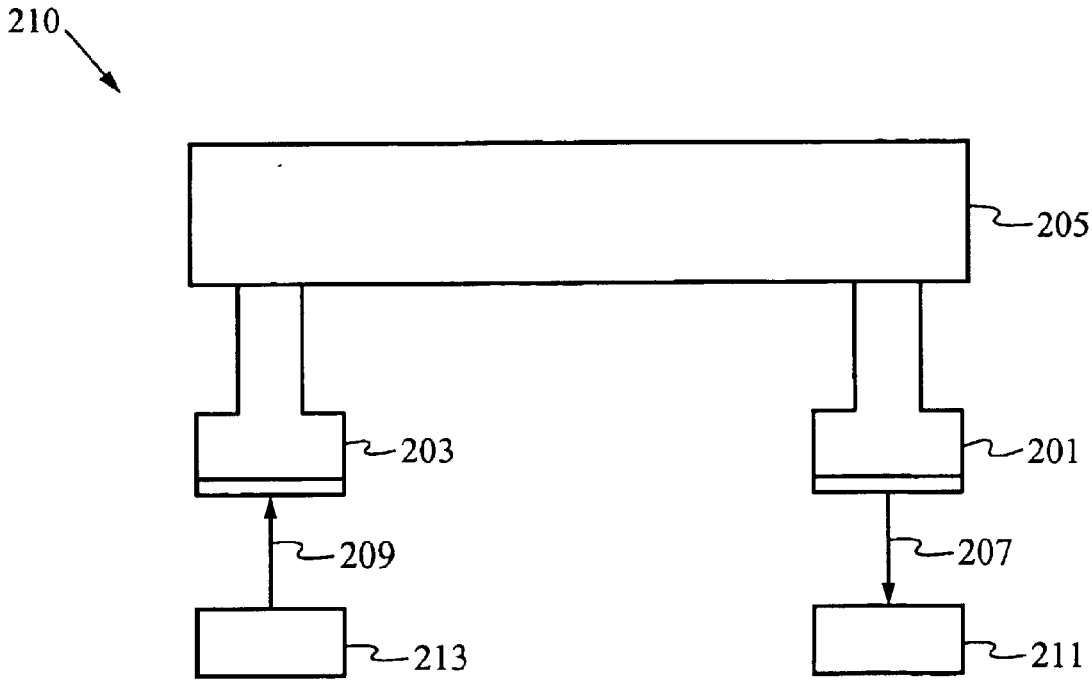

Now referring to FIG. 2*b*, a sensor unit 210 in accordance with a preferred embodiment of the invention, comprises a circuit unit 205, an ultrasonic transmitter 201 and an ultrasonic receiver 203 which are configured to detect motion and generate a response, such as described in detail above. The sensor unit 210 also comprises an acoustic modifier 211 that is preferably positioned in a transmitting path 207 of the ultrasonic transmitter 201 and an acoustic modifier that is preferably positioned in the receiving path 209 of the ultrasonic receiver 203. The acoustic modifiers 211 and 213 are preferably configured to disperse the ultrasonic radiation transmitted from the transmitter 210 and detect the dispersed ultrasonic radiation at the receiver 203.

Figure 3A:
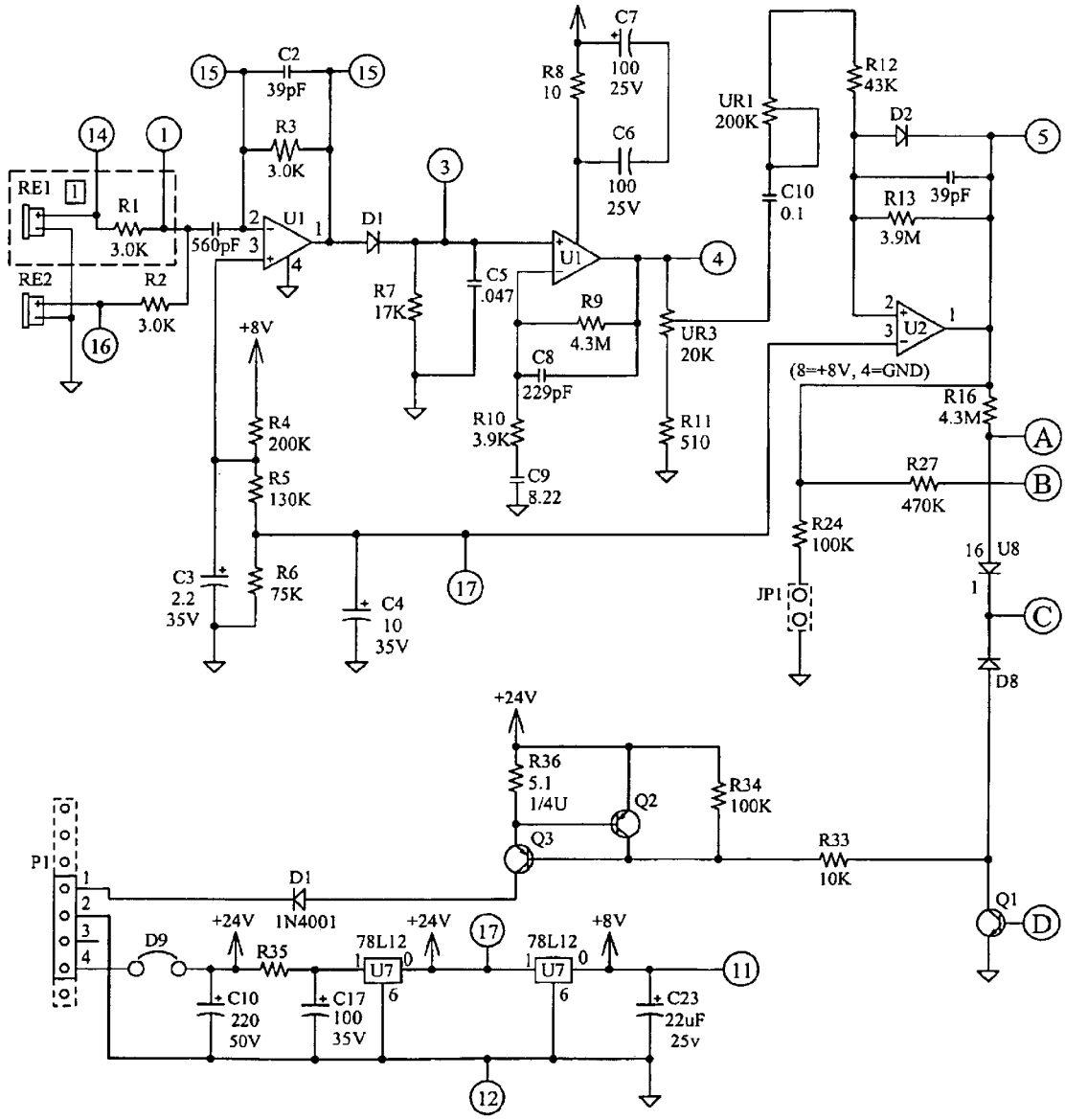
FIGS. 3*a–b* are schematic block diagrams of a representative circuit for coupling to a transducer, in accordance with the instant invention.
Figure 3B:
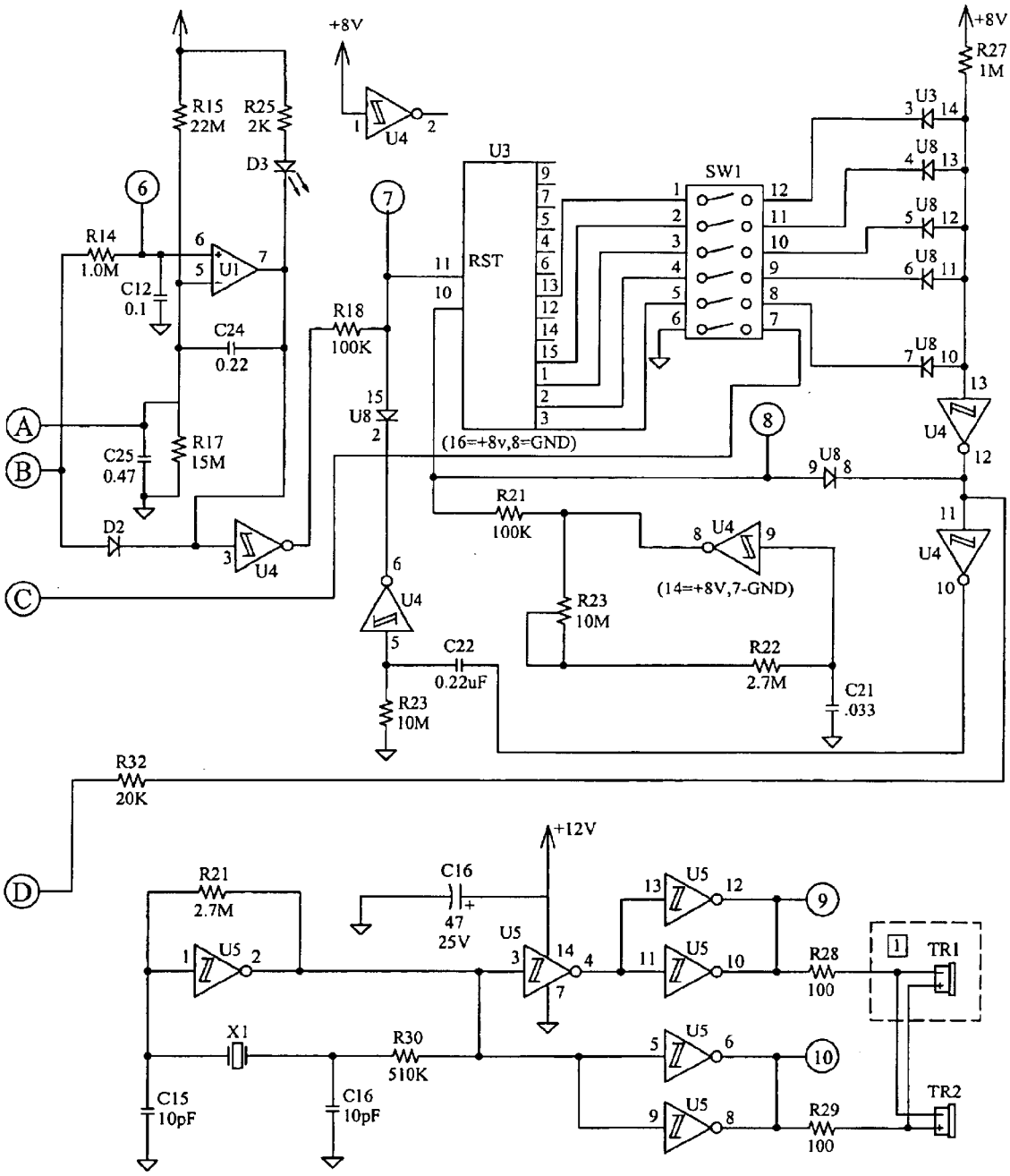

A schematic diagram of an exemplary circuit unit for coupling with one or more transducers and for detecting motion is illustrated in detail in FIGS. 3*a–b*. Placing the FIG. 3*a* and FIG. 3*b* side-by-side such that the reference labels A, B, C, and D in FIG. 3*a* align with the reference labels A, B, C, and D in FIG. 3*b*, produces the entire schematic drawing. The schematic of the circuit shown in FIGS. 3*a–b* is provided herein for completeness and is not intended to limit the scope of the invention. It will be clear to one of ordinary skill in the art that any number of different circuit configurations are within the scope of the instant invention. Further details of exemplary circuits are described in the U.S. Pat. No. 5,189,393, referenced previously.

Figure 4A:
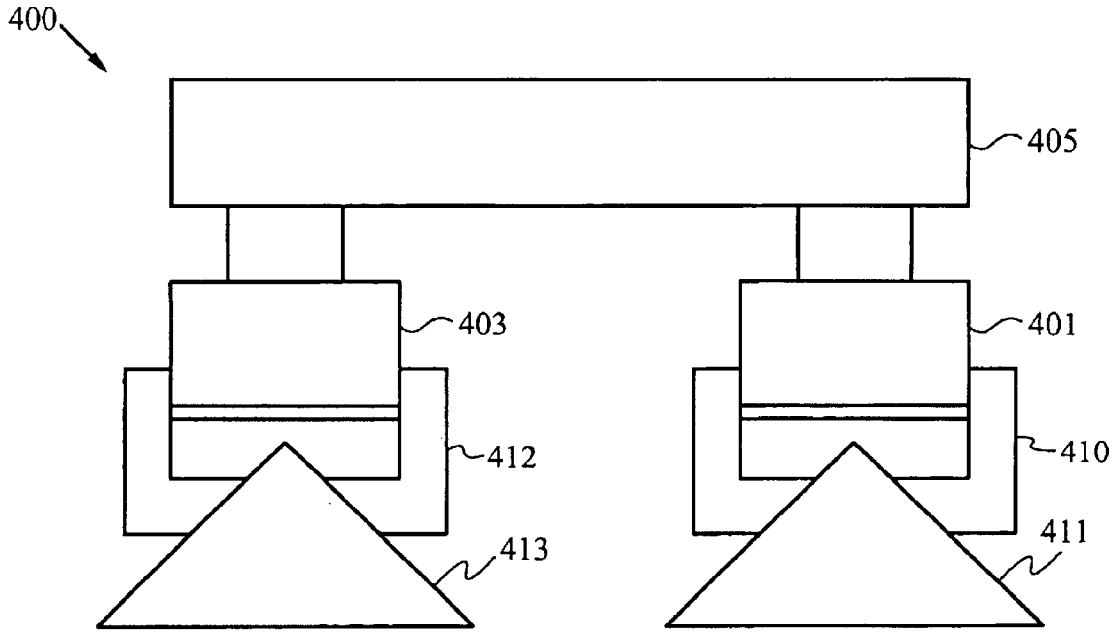
FIG. 4*a* is cross-sectional representation of a sensor unit with acoustic reflectors coupled to an ultrasonic transmitter and an ultrasonic receiver, in accordance with the instant invention.

Now referring to FIG. 4*a*, a sensor unit 400 in accordance with the instant invention comprises a circuit unit 405, an ultrasonic transmitter 401 and an ultrasonic receiver 413 configured to detect motion, as described in detail above. The sensor unit 400 also comprises a pair of acoustic propagation modulators 411 and 413 that are configured to disperse the ultrasonic radiation transmitted from the transmitter 411 and to receive the dispersed ultrasonic radiation at the receiver 413. The acoustic propagation modulators 411 and 413 are preferably acoustic reflectors with angle surfaces, wherein both acoustic reflectors 411 and 413 have similar geometries. In accordance with this embodiment of the instant invention, the acoustic reflectors 411 and 413 are coupled to the transmitter 411 and the receiver 413, as indicated by the lines 410 and 412.

Figure 4B:
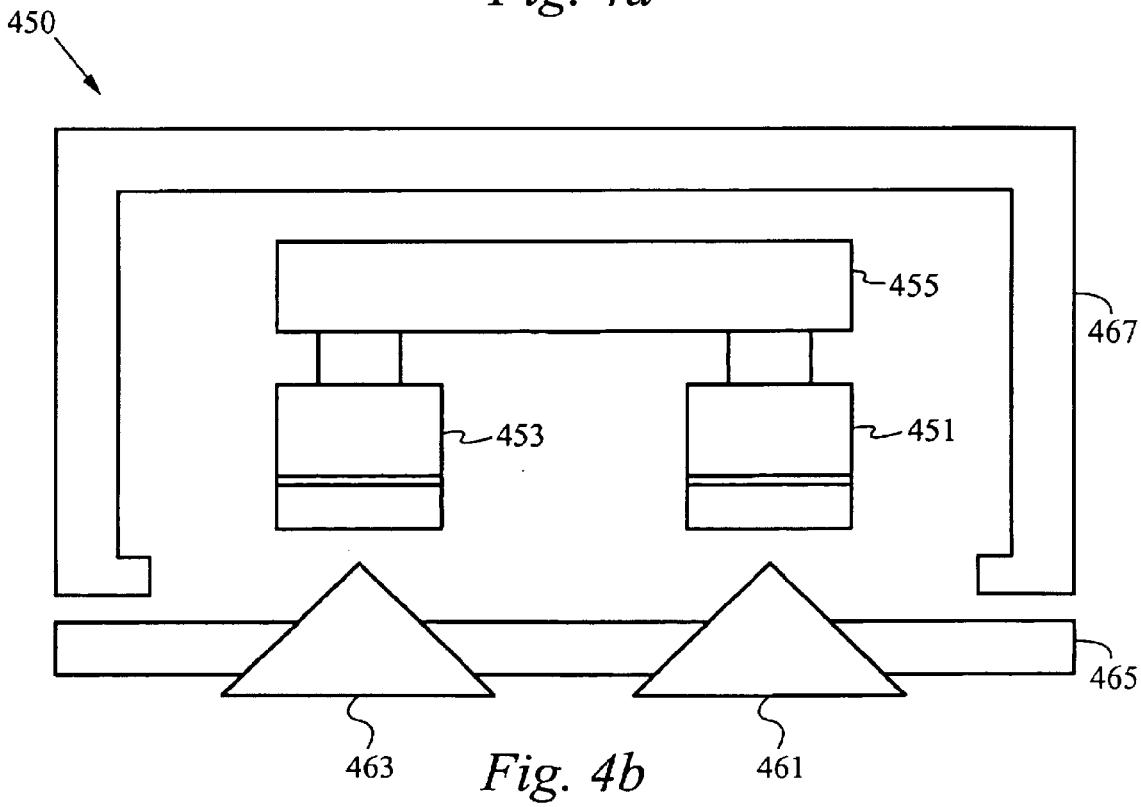
FIG. 4*b* is a cross-sectional representation of a sensor unit with acoustic reflectors coupled to a cover, in accordance with the instant invention.

Now referring to FIG. 4*b*, in accordance with further embodiments of the instant invention, a sensor unit 450 comprises a circuit unit 455, an ultrasonic transmitter 451 and an ultrasonic receiver 453 configured to detect motion, as described in detail above. The sensor unit 450 also comprises an acoustic propagation modulator 465 that is configured to disperse ultrasonic radiation transmitted from the transmitter 451 and to receive the dispersed ultrasonic radiation at the receiver 453. The acoustic propagation modulator 465 preferably comprises angled surfaces 461 and 463 having similar geometries. In accordance with this embodiment, the acoustic propagation modulator 465 is a cover member configured to position the angled surface 461 in the transmitting path of the ultrasonic transmitter 451 and the angled surface 463 in the receiving path of the ultrasonic receiver 453. Preferably, the cover member 465 is configured to couple to a housing section 465 configured to house the circuit unit 455, the ultrasonic transmitter 451 and the ultrasonic receiver 453.

Figure 5:
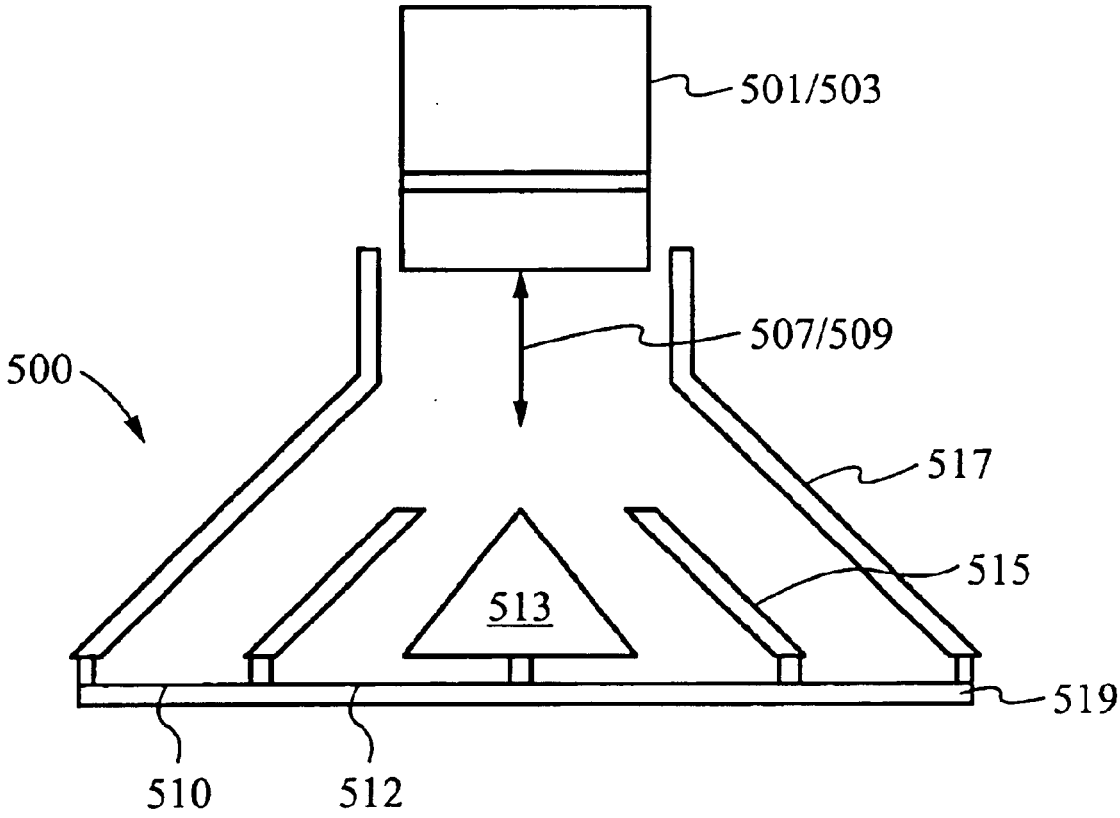
FIG. 5 shows a cross-sectional view of an acoustic reflector for dispersing and receiving ultrasonic radiation, in accordance with the instant invention.

Now referring to FIG. 5, in accordance with the instant invention an acoustic reflector 500 comprises a cone member 513 and/or conical cross-sections 515 and 517. The cone member 513 and the conical cross-sections 515 and 517 are supported through a cross-member 519 configured- to secure the cone member 513 centrally with respect to concentrically positioned conical cross-sections 515 and 517, while allowing ultrasonic radiation to pass through open by spaces 510 and 512 between the cone member 513 and the conical cross-sections 515 and 517. In use, the acoustic reflector 500 is positioned in a transmitting path 507 of a transmitter 501 and a receiving path 509 of a receiver 503, as previously explained. The acoustic reflector 500 is preferably configured to fit over the transmitter 501 and/or the receiver 503. Alternatively, the acoustic reflector 500 is configured to be positioned in the transmitting path 507 of a transmitter 501 and the receiving path 509 of the receiver 503, in any number of different ways, such as through the housing or cover structure, such as described in detail above. Also it will be clear to one skilled in the art, that an acoustic reflector of the instant invention can have any number of conical cross-sections and/or have any variety of different shapes and or shaped structures for dispersing and detecting ultrasonic radiation.

Figure 6A:
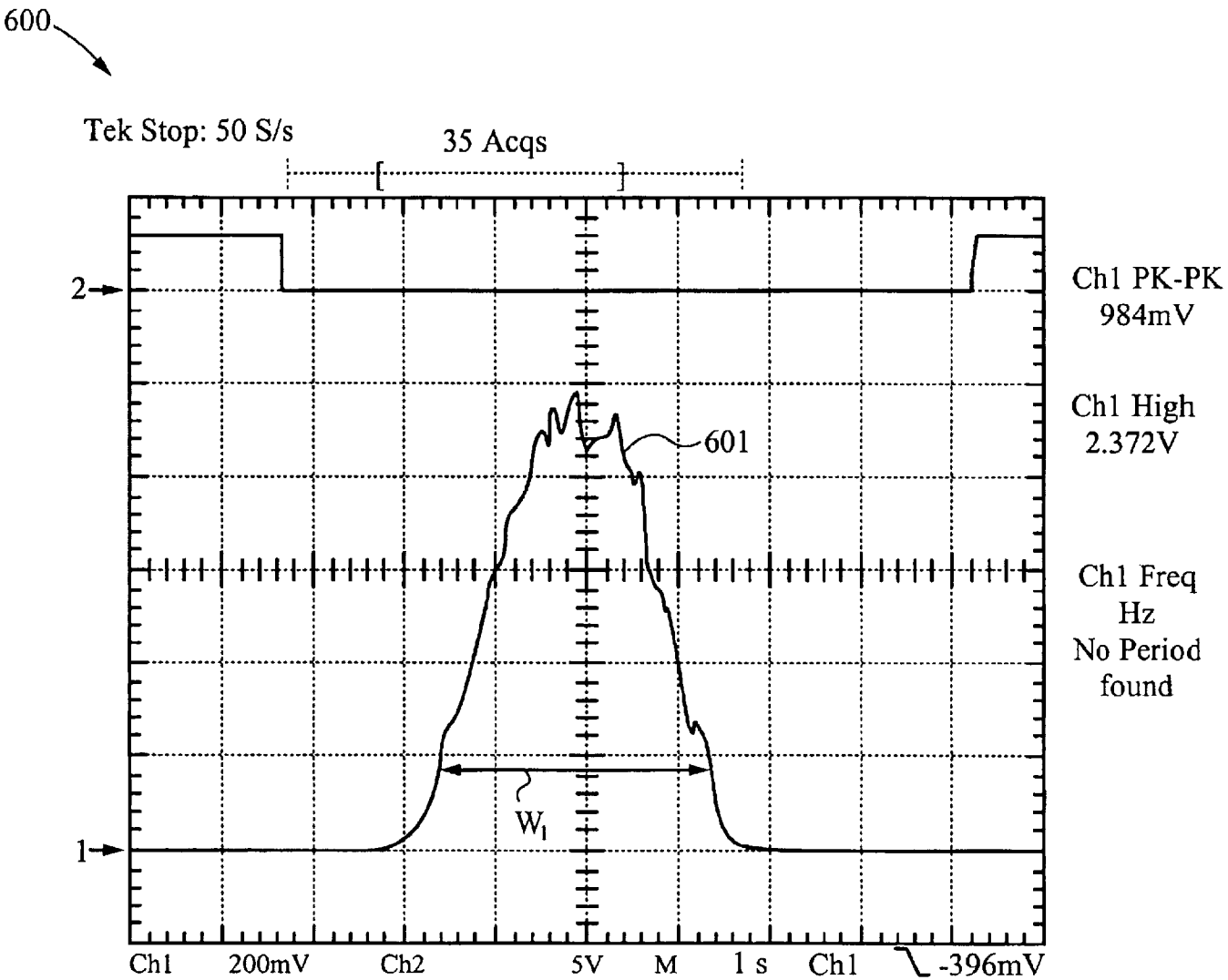
FIGS. 6*a–b* show graphs of receiver signal profiles collected from broadcast regions using an ultrasonic transducer without acoustic reflectors and with acoustic reflectors, respectively.

FIG. 6*a* shows a graph 600, which plots a cross-sectional profile 601 of a receiver signal measured from ultrasonic radiation in a broadcast region, wherein the ultrasonic radiation is generated by an ultrasonic transmitter operating at approximately 40 KHz. The ultrasonic receiver used for generating the signal 601 and the ultrasonic transmitter used for broadcasting the ultrasonic radiation where not equipped with acoustic reflectors of the instant invention. The width $W_1$ of the signal profile 601 is roughly proportional to the dispersion angle of the ultrasonic radiation, which is the cone angle of the effective detection field. The width $W_1$ in FIG. 6*a* corresponds roughly to a cone angle of 30 degrees or less.

Figure 6B:
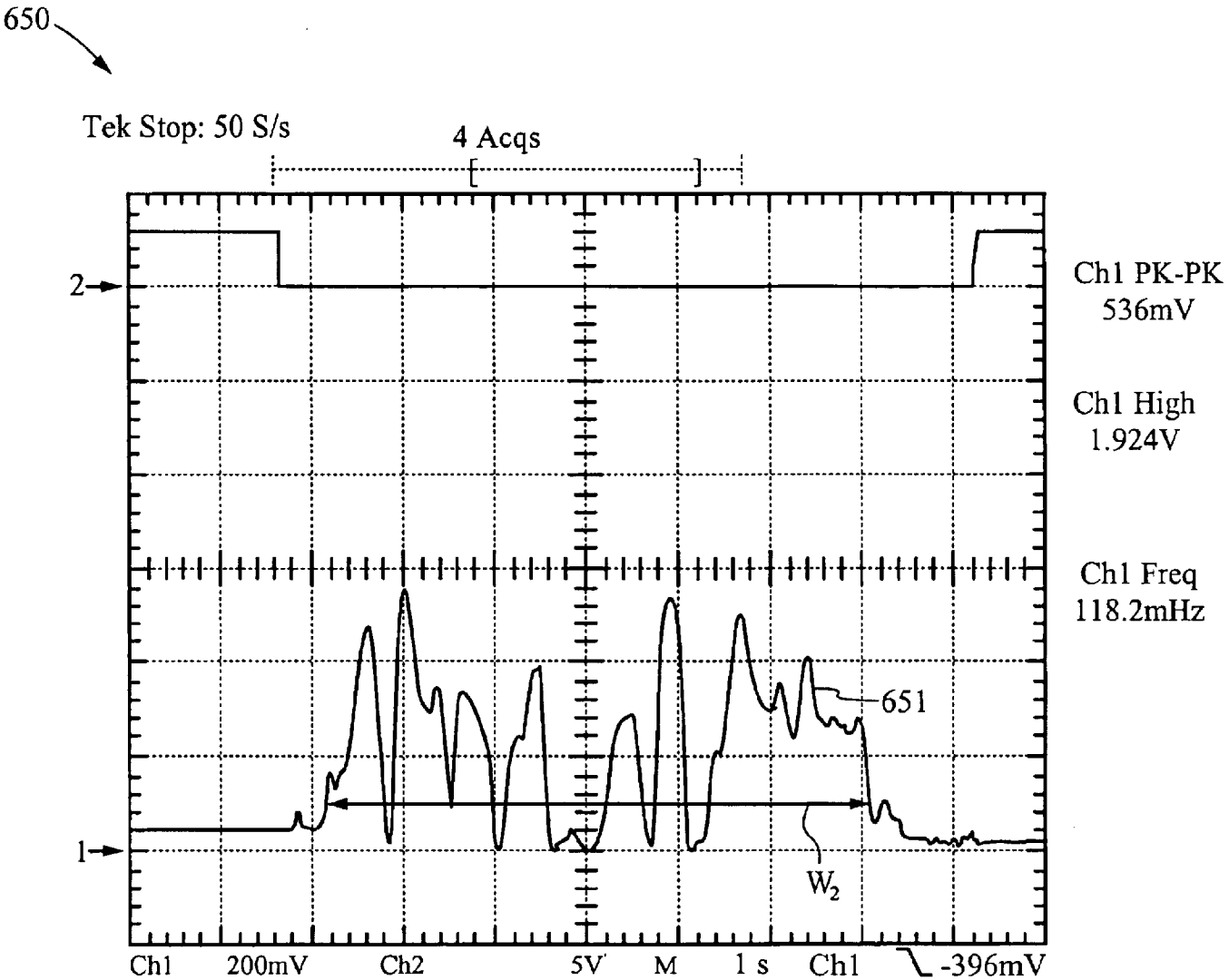

FIG. 6*b* shows a graph 650 which plots a signal profile 651 of a receiver signal measured from an ultrasonic transmitter broadcasting ultrasonic radiation at approximately 40 KHz. The ultrasonic receiver used for detecting the signal 651 and the ultrasonic transmitter used for broadcasting the ultrasonic radiation where equipped with acoustic reflectors, in accordance with the instant invention. Again, the width $W_2$ of the signal profile 651 is roughly proportional to a dispersion angle of the ultrasonic radiation, which is the cone angle of the effective detection field. The width $W_2$ in FIG. 6*b* corresponds to a cone angle of greater than 45 degrees, providing a large improvement in the area which can be monitored using a single detection unit. Additionally, the larger detection area generated by the sensor unit of the instant invention, allows motion detectors utilizing such sensor units to be positioned on the ceiling of a room, while still providing for adequate monitoring capabilities throughout the room.

Figure 7:
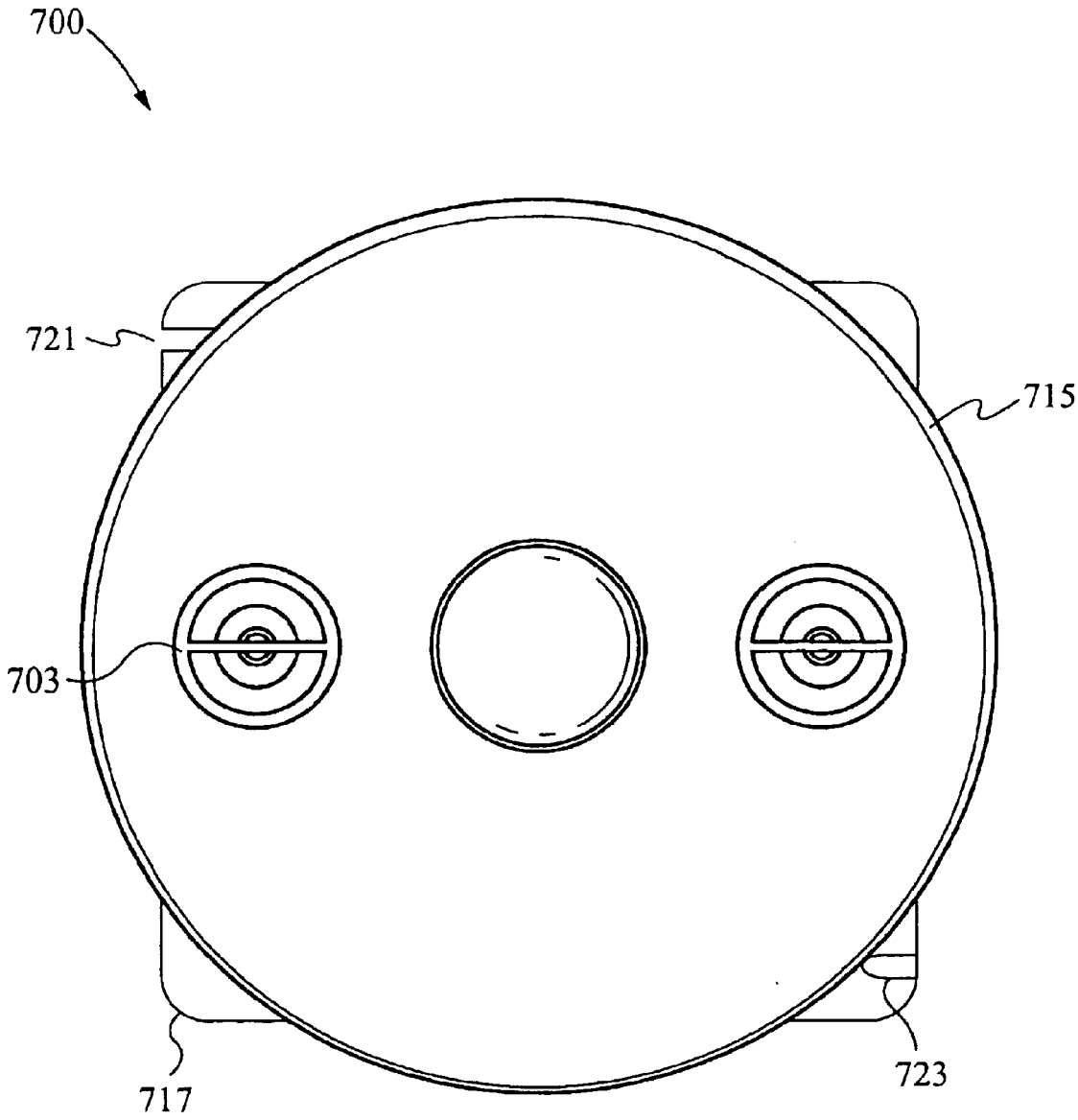
FIG. 7 shows a bottom view of a motion sensor device with acoustic reflectors integrated within a housing configured to mount to a ceiling position, in accordance with the instant invention.

Now referring to FIG. 7, a motion detector 700 of the instant invention is preferably configured to couple to a ceiling position in a room. The motion detector 700 has a housing member 715, which has acoustic reflectors configured to be positioned in a transmitting path of an ultrasonic transmitter and a receiving path of an ultrasonic receiver, housed therein. The motion detector 700 also includes a bracket member 717 which allows the motion detector 700 to be coupled to a junction box to provide power to the motion detector 700 and to allow the motion detector 700 to be recessed into the ceiling of a room. As described previously, the motion detector 700 of the instant invention can also include an infrared sensor (not shown) for monitoring for the presence of people in a room as well as motion within the room.

Figure 8:
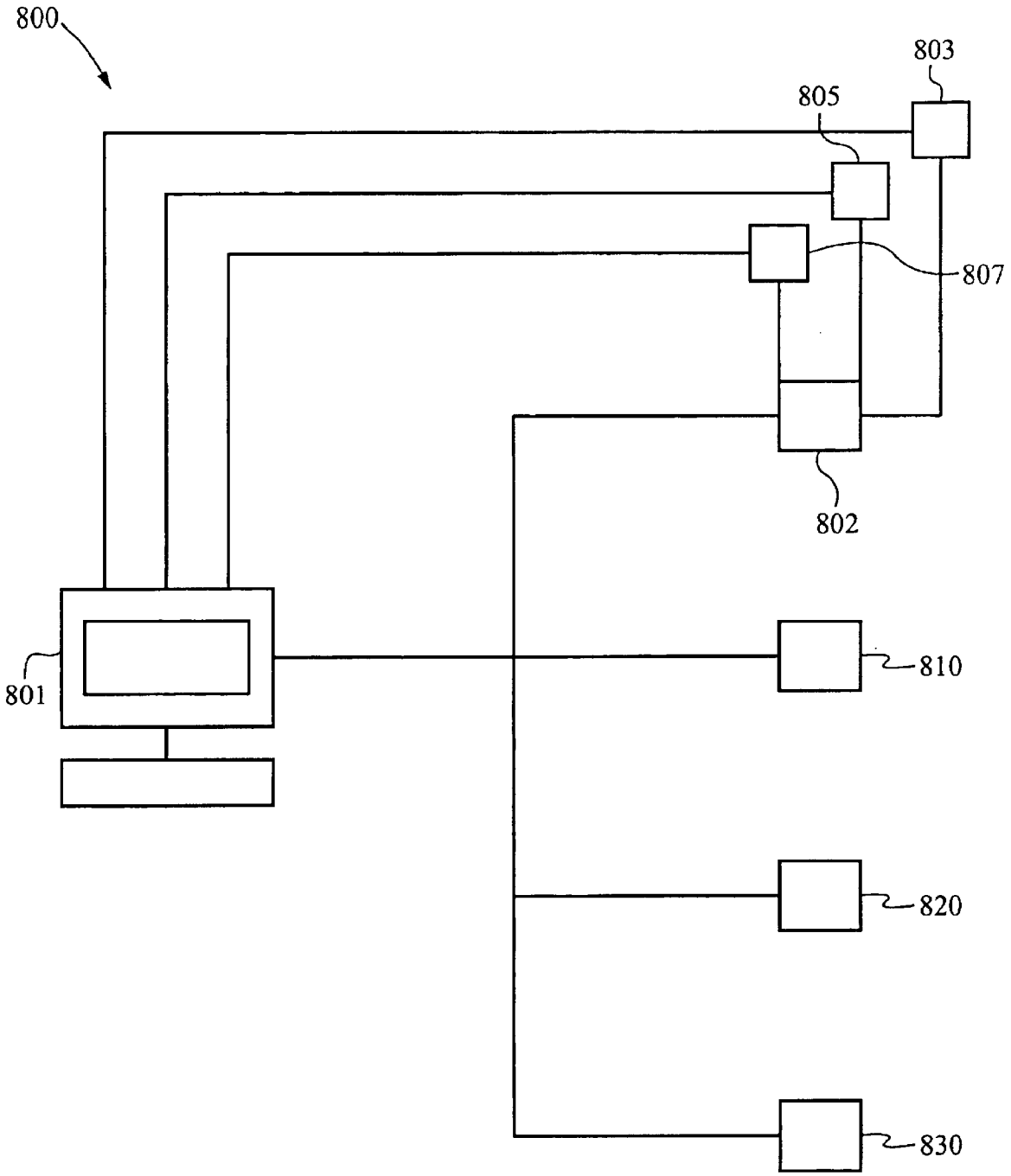
FIG. 8 is a schematic of a motion detector system integrated with multiple response modules, in accordance with a system of the instant invention.

Referring now to FIG. 8, a system 800, in accordance with the instant invention, comprises a number of motion detectors 802, 810 and 820 positioned in various rooms throughout a building (not shown). Each of the motion detectors 802, 810 and 820 has an acoustic modifier, which preferably comprises a pair of matched acoustic reflectors, configured to generate wide angle detection fields, such as those described in detail above. The detectors 802, 810 and 820 are preferably in electrical communication with a central power supply 830, which can be the hard wiring of the building. The motion detectors 802, 810 and 820 can also be coupled to a central computer 801 for operating the motion detectors 802, 810 and 820 and/or for monitoring activities within the building via the motion detectors 802, 810 and 820. The motion detectors 802, 810 and 820 and/or the central computer 801 are coupled to any number of response modules or systems 803, 805 and 807 for generating responses based on the receiving signals of the motion detectors. The response modules 803, 805 and 807 include light management systems, alarm systems or telephone systems which operate lights, alarms or initiate phone calls based on responses of the motion detectors 802, 810 and 820.

The present invention provides the ability to monitor motion from detectors that are positioned on the ceiling of a room. The motion detector device, system and method of the instant invention provides for building management tools which allows for the reduction of the number of detectors required to monitor motion within a building and which are integrated with other building management systems.

The motion detector device, system and method of the instant invention preferably utilize high frequency ultrasound radiation to minimize interference with hearing aides, and in order to minimize potentially adverse physiological effects. The motion detector device, system and method of the instant invention are capable of efficiently utilizing the ultrasonic energy to optimize detection coverage for a given output energy and frequency by dispersing the ultrasound radiation and focusing the ultrasound radiation using a pair of acoustic propagation modifiers, as described above.

While the present invention has been described in terms of specific embodiments incorporating details to facilitate the understanding of the principles of construction and operation of the invention. As such, references, herein, to specific embodiments and details thereof are not intended to limit the scope of the claims appended hereto. It will be apparent to those skilled in the art that modifications can be made in the embodiment chosen for illustration without departing from the spirit and scope of the invention.

What is claimed is:

1. A sensor comprising:

a. a motion sensor unit comprising a transmitter for emitting ultrasonic radiation and a receiver for detecting the ultrasonic radiation; and b. an acoustic propagation modulator configured for dispersing the ultrasonic radiation emitted into broad field ultrasonic radiation and focusing the broad field ultrasonic radiation received to detect motion, the acoustic propagation modulator comprising acoustic reflectors positioned directly in a path of the transmitter and the receiver and coupled to the motion sensor unit, wherein the acoustic reflectors have sloped walls.

2. The sensor of claim 1, wherein the transmitter transmits ultrasonic radiation at a frequency of 20 Kilohertz or above.

3. The sensor of claim 1, further comprising a housing configured for coupling the motion sensor to a ceiling position.

4. The sensor of claim 3, wherein the acoustic propagation modulator is coupled to the housing.

5. The sensor of claim 1, wherein the motion sensor unit comprises a circuit in electrical communication with the transmitter and the receiver, the circuit being configured to drive the transmitter and generate a receiving signal from the receiver.

6. The sensor of claim 5, wherein the circuit is configured to generate a response when changes in the ultrasonic radiation are detected.

7. The sensor of claim 6, wherein the response includes at least one of sounding an alarm and initiating a telephone call.

8. The sensor of claim 1, wherein the acoustic reflectors comprise one or more conical cross-sections.

9. The sensor of claim 8, wherein the one or more conical cross-sections are concentrically positioned.

10. The sensor of claim 1, wherein the acoustic reflectors comprise cone members.

11. A motion detector comprising:

a. means for emitting a wide angle ultrasonic wave comprising:

i) an ultrasonic transmitter; and ii) an acoustic reflector positioned in a transmitting path of the ultrasonic transmitter, wherein the acoustic reflector comprises concentrically positioned conical cross-sections for dispersing the ultrasonic radiation for the transmitter into the wide angle ultrasonic wave;

b. means for receiving the wide angle ultrasonic wave; and c. means for detecting changes in the wide angle ultrasonic wave.

12. The detector of claim 11, wherein the means for receiving the wide angle ultrasonic wave comprises:

a. an ultrasonic receiver; and b. a complementary acoustic reflector positioned in a receiving path of the ultrasonic receiver, such that the wide angle ultrasonic wave received is focused towards the receiver.

13. The detector of claim 12, wherein the acoustic reflector and the complementary acoustic reflector comprise one or more conical cross-sections.

14. The detector of claim 13, wherein the acoustic reflector and the complementary acoustic reflector comprise a cone member positioned centrally with respect to the one or more conical cross-sections.

15. The detector of claim 12, wherein the means for detecting changes in the wide angle ultrasonic wave comprises a circuit in electrical communication with the ultrasonic transmitter and the ultrasonic receiver, the circuit being configured to detect Doppler disturbances in the wide angle ultrasonic wave.

16. The detector of claim 11, further comprising an infrared sensor.

17. The detector of claim 11, wherein the means for emitting a wide angle ultrasonic wave emits ultrasonic radiation dispersed in a detection cone of 45 degrees or more.

18. The detector of claim 11, wherein the means for detecting changes in the wide angle ultrasonic wave comprises a circuit in electrical communication with the means for emitting and the means for receiving.

19. A motion detector unit for detecting motion in a room, the motion detector unit comprising:

a. a transmitter unit with an acoustic reflector positioned directly in a transmission path for producing a broad field detection signal;

b. a receiver unit with a matched acoustic reflector positioned directly in a detection path for receiving the broad field detection signal;

c. a circuit coupled to the transmitter and the receiver for monitoring changes in the detection signal; and d. a housing for coupling to a ceiling of the room and detecting motion therefrom and for housing the transmitter and the receiver, wherein the acoustic reflector and the matched acoustic reflector are coupled to the housing and have sloped walls.

20. The motion detector of claim 19, wherein the acoustic reflector and the matched acoustic reflector are integral with the transmitter unit and the receiver unit, respectively.

21. A system comprising at least one motion detector, the at least one motion detector comprising one or more transducers comprising stationary acoustic modifiers, wherein the stationary acoustic modifiers disperse ultrasonic radiation generated by the one or more transducers into a wide angle ultrasonic wave and focus the wide angle ultrasonic wave received by the one or more transducers, wherein the stationary acoustic modifiers comprise conical sections in the path of the ultrasonic radiation transmitted and the wide angle ultrasonic wave received.

22. A method of detecting motion comprising:

a. generating a dispersed standing wave from a motion sensor unit using a stationary acoustic modulator in a detection area, wherein the stationary acoustic modulator disperses ultrasound radiation generated from an ultrasonic transmitter into broad field ultrasonic standing wave;

b. monitoring the dispersed standing wave using a matched stationary acoustic modulator from the motion sensor unit, wherein the matched stationary acoustic modulator focuses the dispersed standing wave to an ultrasound receiver; and c. detecting changes between the dispersed standing wave, wherein the stationary acoustic modulators each comprises acoustic reflectors having sloped walls and positioned directly in a path of the corresponding transmitter and receiver, respectively.

23. The method of claim 22, wherein generating a dispersed standing wave comprises driving an ultrasound transmitter at a frequency of 20,000 Hz or higher in a path of the stationary acoustic reflector.

24. The method of claim 22, wherein monitoring the dispersed standing wave comprises sensing ultrasonic radiation with an ultrasonic receiver in a path of the matched acoustic reflector.

25. The method of claim 22, further comprising generating a response when detecting changes in the dispersed standing wave.

* * * * *

UNITED STATES PATENT AND TRADEMARK OFFICE

CERTIFICATE OF CORRECTION

PATENT NO. : 6,885,300 B1
DATED : April 26, 2005
INVENTOR(S) : Kendall Ryan Johnston et al.

It is certified that error appears in the above-identified patent and that said Letters Patent is hereby corrected as shown below:

Column 2,
Line 10, replace "transducer is coupled," with -- transducer is coupled --.

Column 5,
Line 15, replace "configured- to secure" with -- configured to secure --.
Line 18, replace "through open by spaces" with -- through open spaces --.

Signed and Sealed this

Thirtieth Day of August, 2005

JON W. DUDAS
*Director of the United States Patent and Trademark Office*